US009472873B1

(12) United States Patent
Jeong et al.

(10) Patent No.: US 9,472,873 B1
(45) Date of Patent: Oct. 18, 2016

(54) REVERSIBLE RECEPTACLE CONNECTOR

(71) Applicant: Lattice Semiconductor Corporation

(72) Inventors: Youchul Jeong, Cupertino, CA (US); Jaemin Kim, Cupertino, CA (US); Hoo Kim, Sunnyvale, CA (US); Baegin Sung, Sunnyvale, CA (US)

(73) Assignee: Lattice Semiconductor Corporation, Portland, OR (US)

( * ) Notice: Subject to any disclaimer, the term of this patent is extended or adjusted under 35 U.S.C. 154(b) by 0 days.

(21) Appl. No.: 14/824,717

(22) Filed: Aug. 12, 2015

(51) Int. Cl.

| | |
|---|---|
| ***H01R 24/00*** | (2011.01) |
| ***H01R 12/70*** | (2011.01) |
| ***H01R 13/642*** | (2006.01) |
| ***H01R 31/06*** | (2006.01) |
| ***H01R 24/58*** | (2011.01) |
| *H01R 103/00* | (2006.01) |

(52) U.S. Cl.
CPC ..... *H01R 12/7076* (2013.01); *H01R 13/642* (2013.01); *H01R 24/58* (2013.01); *H01R 31/06* (2013.01); *H01R 2103/00* (2013.01)

(58) Field of Classification Search
CPC .. H01R 27/00; H01R 31/06; H01R 2013/00; H01R 23/02; H01R 24/58; H01R 23/7073; H01R 23/725; H01R 13/26; H01R 13/658
USPC ..... 439/660, 218, 78
See application file for complete search history.

(56) References Cited

U.S. PATENT DOCUMENTS 4,116,525 A * 9/1978 Johnston ..... H01R 13/33 379/332
4,367,907 A * 1/1983 Buck ..... H01R 24/58 439/188
4,602,830 A * 7/1986 Lockard ..... H01R 24/22 439/108
5,647,765 A * 7/1997 Haas ..... H01R 13/6596 439/607.28
5,915,989 A * 6/1999 Adriaenssens ..... H05K 1/0228 439/404
5,964,610 A * 10/1999 McCoy ..... H01R 25/006 439/215
6,238,250 B1 * 5/2001 Stohr ..... H01R 13/7031 379/413.04
6,558,203 B2 * 5/2003 Pocrass ..... H01R 13/7175 439/218
6,595,805 B2 * 7/2003 Pocrass ..... H01R 13/7175 439/218
6,866,527 B2 * 3/2005 Potega ..... H01R 24/58 439/218
6,935,879 B2 * 8/2005 Whitney ..... H01R 13/6666 439/181
7,361,059 B2 * 4/2008 Harkabi ..... H01R 27/00 439/218

(Continued)

*Primary Examiner* — Chandrika Prasad
*Assistant Examiner* — Vladimir Imas
(74) *Attorney, Agent, or Firm* — Fenwick & West LLP

(57) ABSTRACT

Embodiments relate to a receptacle assembly for connecting to a plug of a connector. The receptacle includes a first contact on a first side of an insulating member. The first contact electrically connects to a first plug contact when the connector engages with the receptacle in a first orientation. The receptacle includes a second contact on a second side of the insulating member. The second contact electrically connects to the first plug contact when the connector engages with the receptacle in a second orientation. The second contact extends to a printed circuit board and is connected to the first contact via a first conductive bridge at a first location closer to the printed circuit board than the first plug contact. The first and second contacts are connected via a second conductive bridge at a second location closer to the first plug contact than the first conductive bridge.

20 Claims, 8 Drawing Sheets

(56) References Cited

U.S. PATENT DOCUMENTS 7,416,419 B2 * 8/2008 Collantes, Jr. ..... H05K 9/0067 439/76.1
7,537,471 B2 * 5/2009 Teicher ..... H01R 13/64 439/172
7,581,967 B2 * 9/2009 Collantes, Jr. ..... H01R 13/6485 439/131
7,601,034 B1 * 10/2009 Aekins ..... H01R 13/6464 439/676
7,682,169 B2 * 3/2010 Park ..... H01R 25/006 439/159
7,708,566 B2 * 5/2010 Sabo ..... H01R 13/6485 439/181
7,824,222 B2 * 11/2010 Miyoshi ..... H01R 13/5845 439/607.41
7,963,773 B2 * 6/2011 Palli ..... H01R 13/6205 439/38
8,021,183 B2 * 9/2011 Early ..... H01R 13/665 439/382
8,125,748 B2 * 2/2012 Zheng ..... H01H 83/04 361/42
8,152,558 B2 * 4/2012 Broeksteeg ..... B60R 11/0241 439/378
8,198,563 B2 * 6/2012 Tsai ..... H01R 23/10 218/118
8,517,751 B1 * 8/2013 Golko ..... H01R 13/516 439/218
8,782,869 B2 * 7/2014 Dolci ..... H01R 13/633 29/426.6
8,911,260 B2 * 12/2014 Golko ..... H01R 13/6581 439/108
8,911,262 B1 * 12/2014 Leiba ..... H01R 24/60 439/660
8,944,827 B2 * 2/2015 Ohsaka ..... H01R 12/57 439/581
9,024,581 B2 * 5/2015 McGinley ..... H01R 31/065 320/111
9,033,739 B2 * 5/2015 Sloey ..... H01R 13/5202 439/607.35
9,142,926 B2 * 9/2015 Tsai ..... H01R 24/60
9,231,344 B1 * 1/2016 Liao ..... H01R 23/02
9,231,356 B1 * 1/2016 Ju ..... H01R 24/78
2006/0024997 A1 * 2/2006 Teicher ..... H01R 27/00 439/217
2008/0119076 A1 * 5/2008 Teicher ..... H01R 13/64 439/171
2008/0119291 A1 * 5/2008 Takamoto ..... A63F 13/02 463/47
2008/0248662 A1 * 10/2008 Bazayev ..... H01H 9/0264 439/107
2008/0311781 A1 * 12/2008 Wojcik ..... H01R 13/506 439/352
2009/0286411 A1 * 11/2009 Bazayev ..... H01H 9/0264 439/145
2011/0294354 A1 * 12/2011 Chen ..... H01R 12/724 439/660
2012/0015561 A1 * 1/2012 Tsai ..... H01R 24/60 439/660
2013/0005193 A1 * 1/2013 Tsai ..... H01R 13/6315 439/676
2013/0095702 A1 * 4/2013 Golko ..... H01R 13/6273 439/676
2014/0206209 A1 * 7/2014 Kamei ..... H01R 24/60 439/81

* cited by examiner

REVERSIBLE RECEPTACLE CONNECTOR

BACKGROUND

1. Field of the Disclosure

This disclosure pertains in general to receptacle connectors, and more specifically to reversible receptacle connectors for connecting electric paths.

2. Description of the Related Art

Electronic devices often include data connectors that receive or provide power and communicate data. The connectors are traditionally female receptacles designed to receive male connectors. The receptacle connects electrical paths of the connector to an electronic device. A reversible receptacle can receive a reversible connector in two possible orientations. The reversible receptacle ensures a positive connection between the connector and the receptacle regardless of the relative orientation of the connector. The receptacle includes a pair of contacts. The contacts are connected together by a conductive bridge, typically at a location close to a printed circuit board (PCB). The reversible receptacle including only the first conductive bridge limits the bandwidth and degrades the signal quality of signals transmitted on the pair of contacts. Examples of reversible receptacles include Universal Serial Bus (USB) Type C receptacles and Super Mobile High-Definition Link (MHL) receptacles.

SUMMARY

Embodiments relate to a receptacle assembly for connecting to a plug of a connector. The receptacle includes an insulating member, contacts, and conductive bridges. The receptacle includes a first contact on a first side of the insulating member. The first contact electrically connects to a first plug contact of the connector when the connector engages with the receptacle in a first orientation. The receptacle further includes a second contact on a second side of the insulating member. The second contact electrically connects to the first plug contact of the connector when the connector engages with the receptacle in a second orientation. The second contact extends to a printed circuit board of an electric device and is connected to the first contact via a first conductive bridge at a first location closer to the printed circuit board than the first plug contact. The first and second contacts are connected via a second conductive bridge at a second location closer to the first plug contact than the first conductive bridge.

In one embodiment, the second conductive bridge is formed to penetrate the insulating member and the first conductive bridge is separated away from the insulating member.

In one embodiment, a distance between the first and second conductive bridge along the first contact is less than 15 mm/$\sqrt{\epsilon_r}$, where $\epsilon_r$ is the relative permittivity of the insulating member.

In one embodiment, the second conductive bridge includes a first portion extending from the first contact into the insulating member, a second portion extending from the second contact into the insulating member, and a conductive path extending between the first portion and the second portion. The conductive path is parallel to a top or bottom surface of the insulating member when the plug engages with the receptacle in the second orientation.

In one embodiment, the first contact includes a first portion extending on the first side of the insulating member at a first height and is parallel to the first side of the insulating member. The first contact further includes a second portion extending to the printed circuit board parallel to the first side of the insulating member at a second height lower than the first height. The first contact includes a third portion connecting the first and second portions of the first contact.

BRIEF DESCRIPTION OF THE DRAWINGS

The teachings of the embodiments disclosed herein can be readily understood by considering the following detailed description in conjunction with the accompanying drawings.

DETAILED DESCRIPTION

Figure 1:
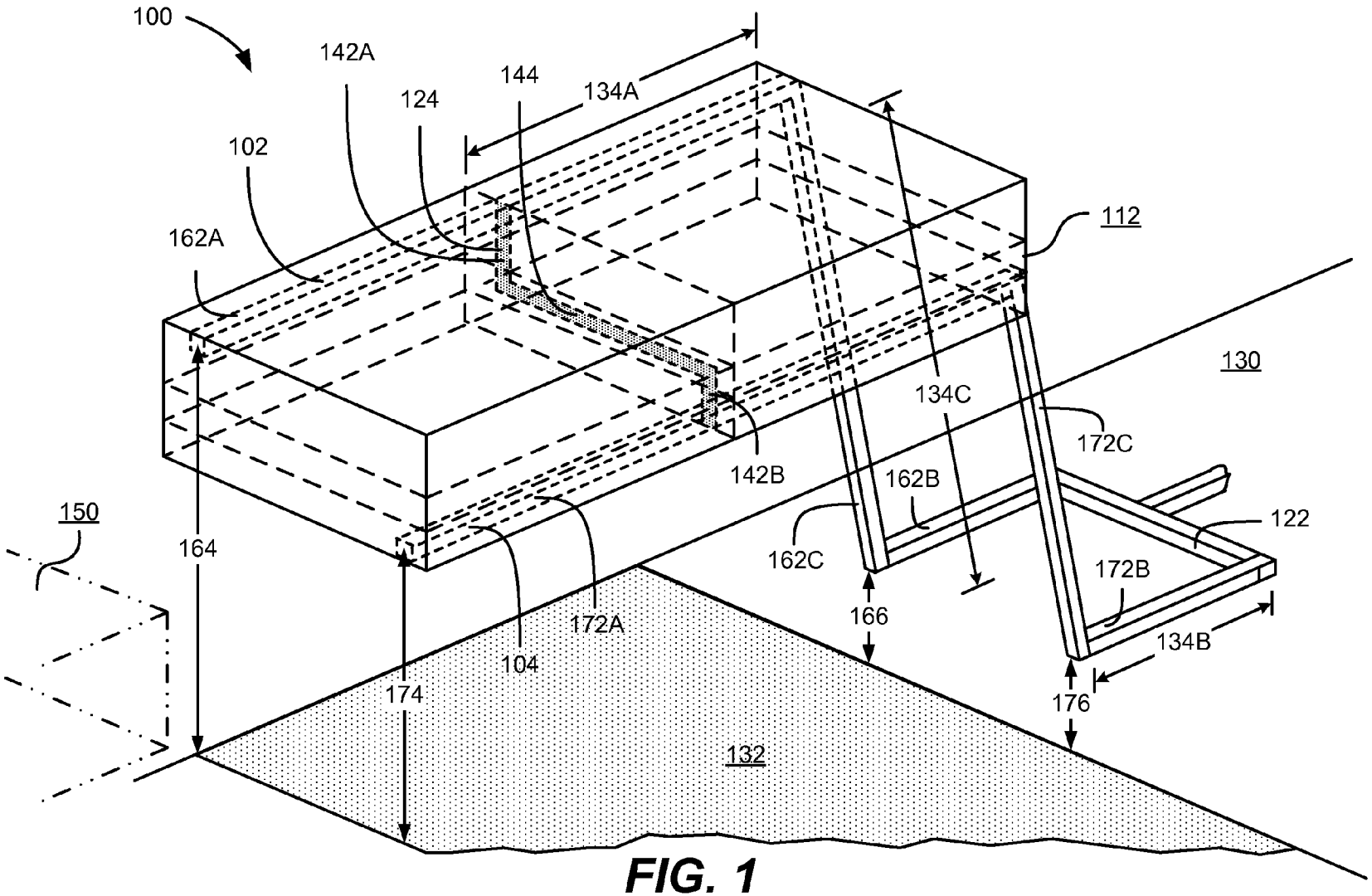
FIG. 1 is a perspective view of a receptacle for connecting to a plug of a connector, according to one embodiment.

The Figures (FIG.) and the following description relate to various embodiments by way of illustration only. It is noted that wherever practicable similar or like reference numbers may be used in the figures may indicate similar or like functionality. Alternative embodiments of the structures and methods disclosed herein will be readily recognized as viable alternatives that may be employed without departing from the principles discussed herein. Reference will now be made in detail to several embodiments, examples of which are illustrated in the accompanying figures.

A receptacle receives one or more plugs from a connector and electrically connects the connector to an electronic device. The female receptacle receives one or more male plugs of the connector and electrically connects the connector to the electronic device. The receptacle transmits power and data from the connector to the electronic device, and vice versa.

Some receptacles are reversible. A reversible receptacle receives a reversible connector in two possible orientations. In both orientations, the reversible connectors provide the same connectivity to the electronic device so that users can conveniently use either orientation of the connector to connect the electronic device. Examples of the reversible receptacle include Universal Serial Bus (USB) Type C receptacles and Super Mobile High-Definition Link (MHL) receptacles.

The reversible receptacle includes a pair of contacts. The contacts are on either side of an insulating member in the reversible receptacle. The contacts extend from the connector to a printed circuit board (PCB) of the electronic device. The contacts are connected together by a first conductive bridge at a location close to the PCB. The first conductive bridge is not connected to the connector and therefore acts as an open stub in the receptacle. The open stub causes undesirable capacitance between the contacts of the reversible connectors which in turn causes crosstalk between a signal transmitted on the contacts. Crosstalk occurs when a signal transmitted on one part of a device (e.g., one of the contacts of the reversible receptacle) creates an undesired effect in another part of the device (e.g., the other one of the contacts of the reversible receptacle). The crosstalk limits the bandwidth and degrades the signal quality of the signal transmitted via the contacts.

Embodiments relate to providing a second conductive bridge connecting the contacts in a receptacle at a location closer to the connector than the first conductive bridge to reduce the capacitance introduced by the open stub. The first and second conductive bridges are separated by a distance. The reducing of the capacitance in turn reduces the crosstalk between the signal transmitted on the contacts. The second conductive bridge reduces the effect of the open stub thereby increasing the bandwidth of and improving the signal quality of the signal than receptacles with a single conductive bridge at a location closer to the PCB than the connector.

FIG. 1 is a perspective view of a receptacle 100 for connecting to a plug of a connector 150, according to one embodiment. The receptacle 100 connects electrical paths of the connector 150 to an electronic device including a printed circuit board (PCB) 130. The receptacle 100 includes, among other components, a first contact 102, a second contact 104, an insulating member 112, a first conductive bridge 122, and a second conductive bridge 124. The receptacle 100 includes additional contacts which are omitted in FIG. 1 to simplify the explanation.

The first contact 102 and the second contact 104 transmit signals from the connector 150 to the PCB 130 of the electronic device. The first contact 102 and the second contact 104 can be implemented using metal traces. The first contact 102 is on a first side (i.e., top-side) of the insulating member 112 and the second contact 104 is on a second side (i.e., bottom-side) of the insulating member 112. The first contact 102 and the second contact 104 extend to the PCB 130 of the electronic device.

The first contact 102 includes a first portion 162A extending on the first side (i.e., top-side) of the insulating member 112 at a first height 164 from a PCB surface 132 and parallel to the first side of the insulating member 112. The first contact 102 further includes a second portion 162B extending to the PCB 130 parallel to the first side of the insulating member 112 at a second height 166 from the PCB surface 132 lower than the first height 164. In one embodiment, the second height 166 from the PCB surface 132 is zero (i.e., the second portion 162B is on the PCB surface 132). The first contact 102 includes a third portion 162C connecting the first portion 162A and the second portion 162B of the first contact 102.

Similarly, the second contact 104 includes a first portion 172A at a third height 174 from the PCB surface 132 and parallel to the second side (i.e., bottom-side) of the insulating member 112, a second portion 172B extending to the PCB 130 parallel to the second side of the insulating member 112 at a fourth height 176 from the PCB surface 132 lower than the third height 174, and a third portion 172C connecting the first portion 172A and the second portion 172B of the second contact 104. In one embodiment, the third height 174 is lower than the first height 164 and higher than the second height 166, and the fourth height 176 and the second height 166 are substantially the same. In one embodiment, the fourth height 176 from the PCB surface 132 is zero (i.e., the second portion 172B is on the PCB surface 132.

The insulating member 112 separates the first contact 102 and the second contact 102 within the receptacle 100. The insulating member 112 has a sheet-like structure and separates a first side (e.g., top-half) of the receptacle 100 from a second side (e.g., bottom-half) of the receptacle 100. The insulating member 112 prevents signals transmitted via contacts (e.g., first contact 102) at one side (e.g., top-side) of the insulating member 112 from affecting signals transmitted via contacts (e.g., second contact 104) at another side (e.g., bottom-side) of the insulating member 112. In one embodiment, the insulating member 112 is an insulative plastic or any other composite material.

The connector 150 engages with the receptacle 100 in each of two orientations. That is, the connector 150 may engage with the receptacle 100 in a first orientation while the connector 150 may also engage with the receptacle 100 in a second orientation rotated 180 degrees relative to the first orientation without reconfiguration. Conductive bridges are provided in the receptacle 100 so that plug contacts of the connector 150 may engage with the appropriate contacts of the receptacle 100 in either orientation.

In the embodiment of FIG. 1, the first conductive bridge 122 connects the first contact 102 and the second contact 104 at a first location closer to the PCB 130 than the connector 150. Specifically, the first conductive bridge 122 connects the second portion 162B of the first contact 102 and the second portion 172B of the second contact 104. In one embodiment, the first conductive bridge 122 height (not shown) from the PCB surface 132 is zero (i.e., the first conductive bridge 122 is on the PCB surface 132). The first conductive bridge 122 is not connected to the connector 150 and acts as an open stub in the receptacle 100. The open stub causes undesirable capacitance between the first contact 102 and the second contact 104 which in turn causes crosstalk between a signal transmitted on the first contact 102 and the second contact 104.

The receptacle 100 also includes the second conductive bridge 124 to reduce the capacitance introduced by the open stub which in turn reduces the crosstalk between the signal transmitted on the first contact 102 and the second contact 104. The second conductive bridge 124 connects the first contact 102 and the second contact 104 at a second location closer to the connector 150 than the first conductive bridge 122. Specifically, the second conductive bridge 124 connects the first portion 162A of the first contact 102 and the first portion 172A of the second contact 104.

In one embodiment, the second conductive bridge 124 is formed to penetrate the insulating member 112 and the first conductive bridge 122 is separated away from the insulating member 112. The second conductive bridge 124 includes a first portion 142A extending from the first portion 162A of the first contact 102 into the insulating member 112, a second portion 142B extending from the first portion 172A of the second contact 104 into the insulating member 112, and a first conductive bridge 144 extending between the first portion 142A and the second portion 142B. The first conductive bridge 144 extends from the first portion 142A to the second portion 142B and is parallel to the top or bottom surface of the insulating member 112. The second conductive bridge 124 is not limited to the structure illustrated in FIG. 1.

In one embodiment, the first conductive bridge 122 and the second conductive bridge 124 are separated by a distance along the path of the signals. As illustrated in FIG. 1, the distance is the sum of length 134A, length 134B, and length 134C. The distance between the first conductive bridge 122 and the second conductive bridge 124 is less than 15 mm/$\sqrt{\epsilon_r}$, where $\epsilon_r$ represents the relative permittivity of the insulating member 112. If the distance between the first conductive bridge 122 and the second conductive bridge 124 is greater than 15 mm/$\sqrt{\epsilon_r}$, the bandwidth is limited and signal quality degrades. Therefore, it is advantageous for the distance between the first conductive bridge 122 and the second conductive bridge 124 is less than 15 mm/$\sqrt{\epsilon_r}$. In the embodiment where the insulating member 112 is air, the distance between the first conductive bridge 122 and the second conductive bridge 124 is less than 15 mm.

Figure 2A:
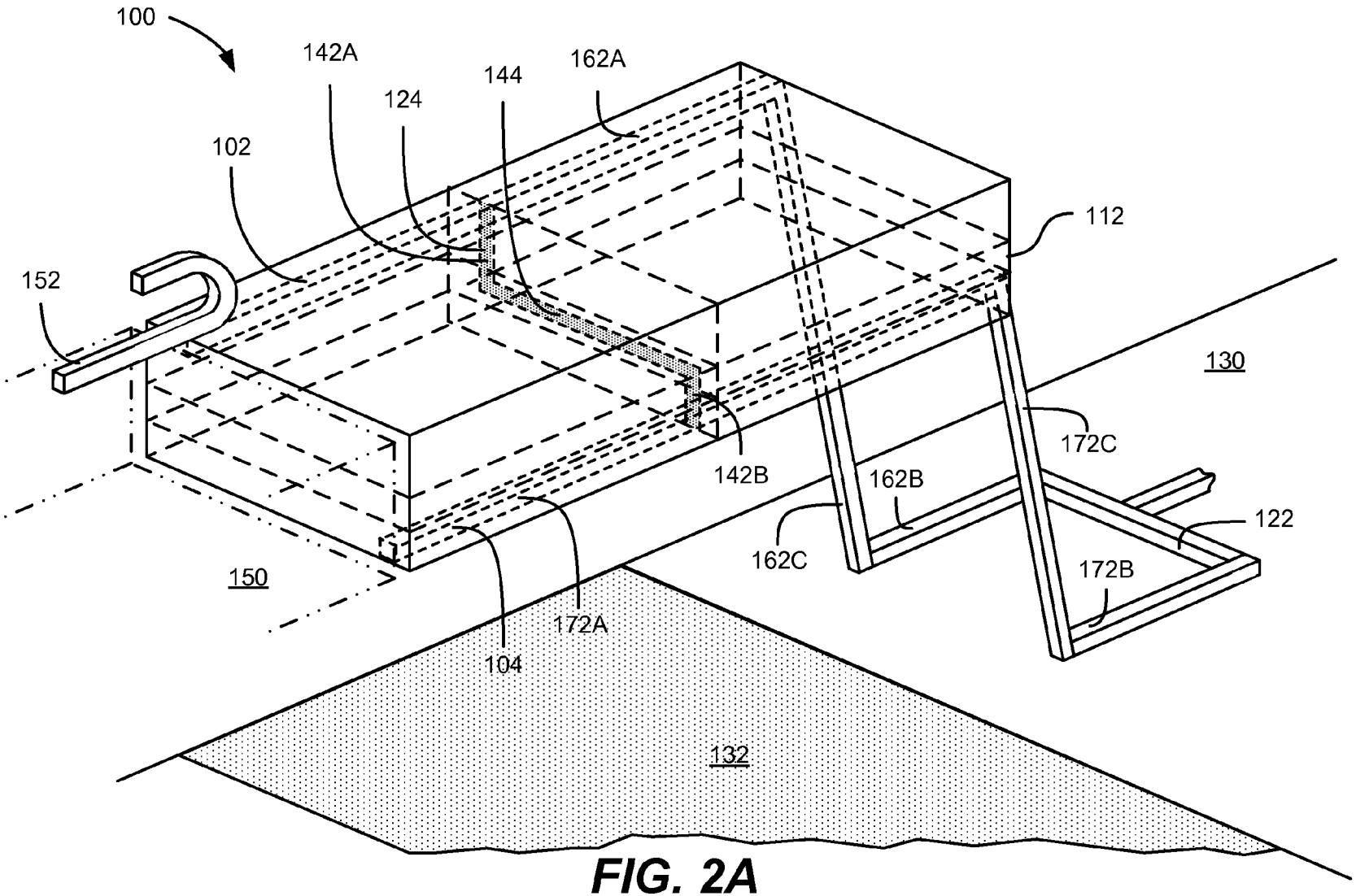
FIG. 2A is a perspective view of the receptacle illustrating the connector in a first orientation where a first plug contact of the connector is connected to a first contact of the receptacle, according to one embodiment.

FIG. 2A is a perspective view of the receptacle 100 illustrating the connector 150 in the first orientation where a first plug contact 152 of the connector 150 is connected to first contact 102 of the receptacle 100, according to one embodiment. FIG. 2A illustrates the same embodiment of the receptacle 100 illustrated in FIG. 1 with the connector 150 engaging with the receptacle 100 in the first orientation. The first contact 102 at the first side (i.e., top side) of the receptacle 100 electrically couples with the first plug contact 152 when the connector 150 engages with the receptacle 100 in the first orientation. When electrically coupled with the first plug contact 152, the receptacle 100 transmits a signal from the first plug contact 152 of the connector 150 to the PCB 130 of the electronic device via the first conductive bridge 122 and the second conductive bridge 124.

Figure 2B:
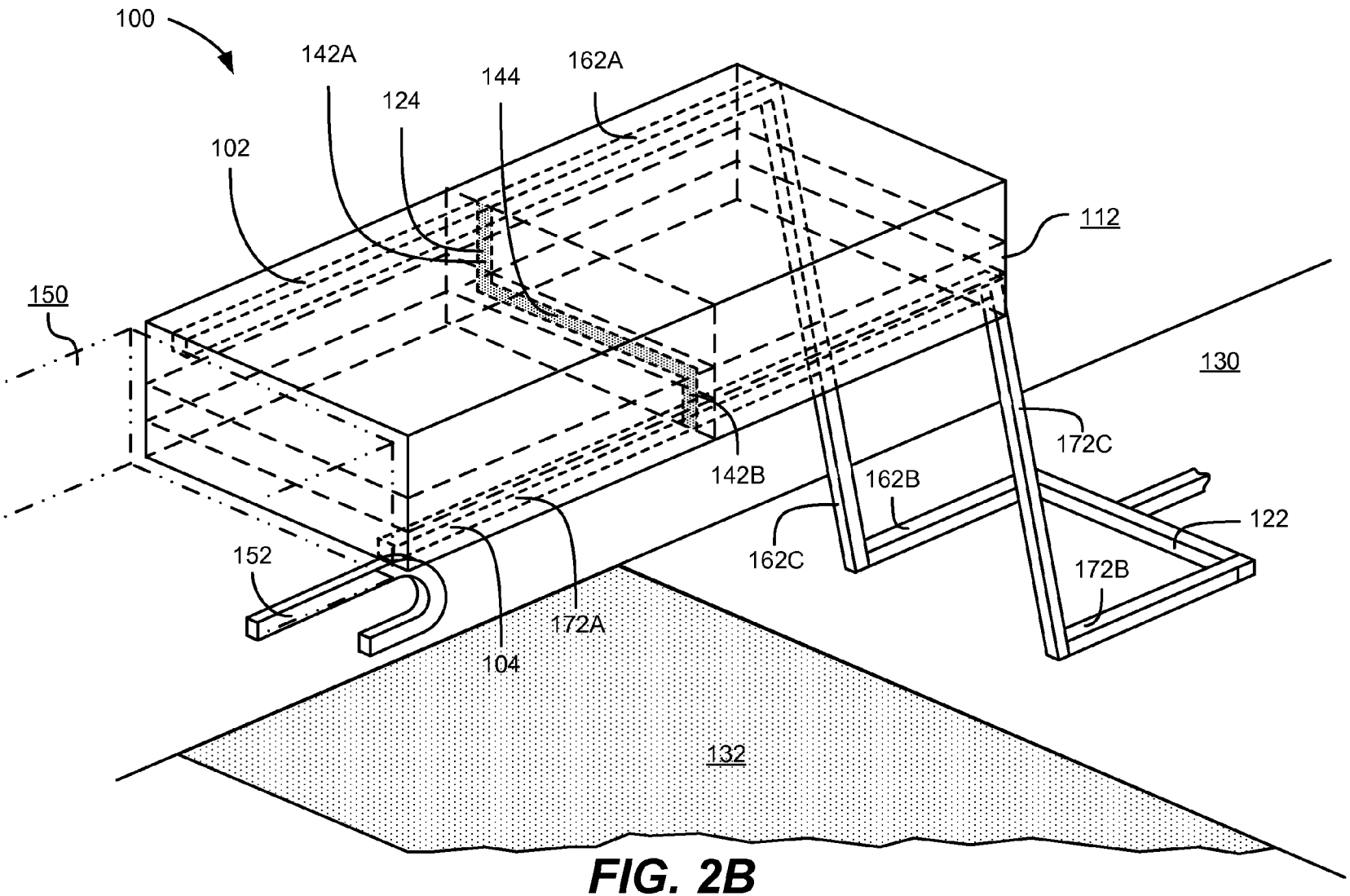
FIG. 2B is a perspective view of the receptacle illustrating the connector in a second orientation where a first plug contact of the connector is connected to a second contact of the receptacle, according to one embodiment.

FIG. 2B is a perspective view of the receptacle 100 illustrating the connector 150 in a second orientation where the first plug contact 152 of the connector 150 is connected to the second contact 104 of the receptacle 100, according to one embodiment. FIG. 2B illustrates the same embodiment of the receptacle 100 illustrated in FIG. 1 with the connector 150 engaging with the receptacle 100 in the second orientation. That is, FIG. 2B illustrates the same embodiment as FIG. 2A but with the orientation of the connector 150 reversed. The second contact 104 at the second side (i.e., bottom side) of the receptacle 100 electrically couples with the first plug contact 152 when the connector 150 engages with the receptacle 100 in the second orientation. When electrically coupled with the first plug contact 152, the receptacle 100 transmits a signal from the first plug contact 152 of the connector 150 to the PCB 130 of the electronic device via the first conductive bridge 122 and the second conductive bridge 124.

Figure 2C:
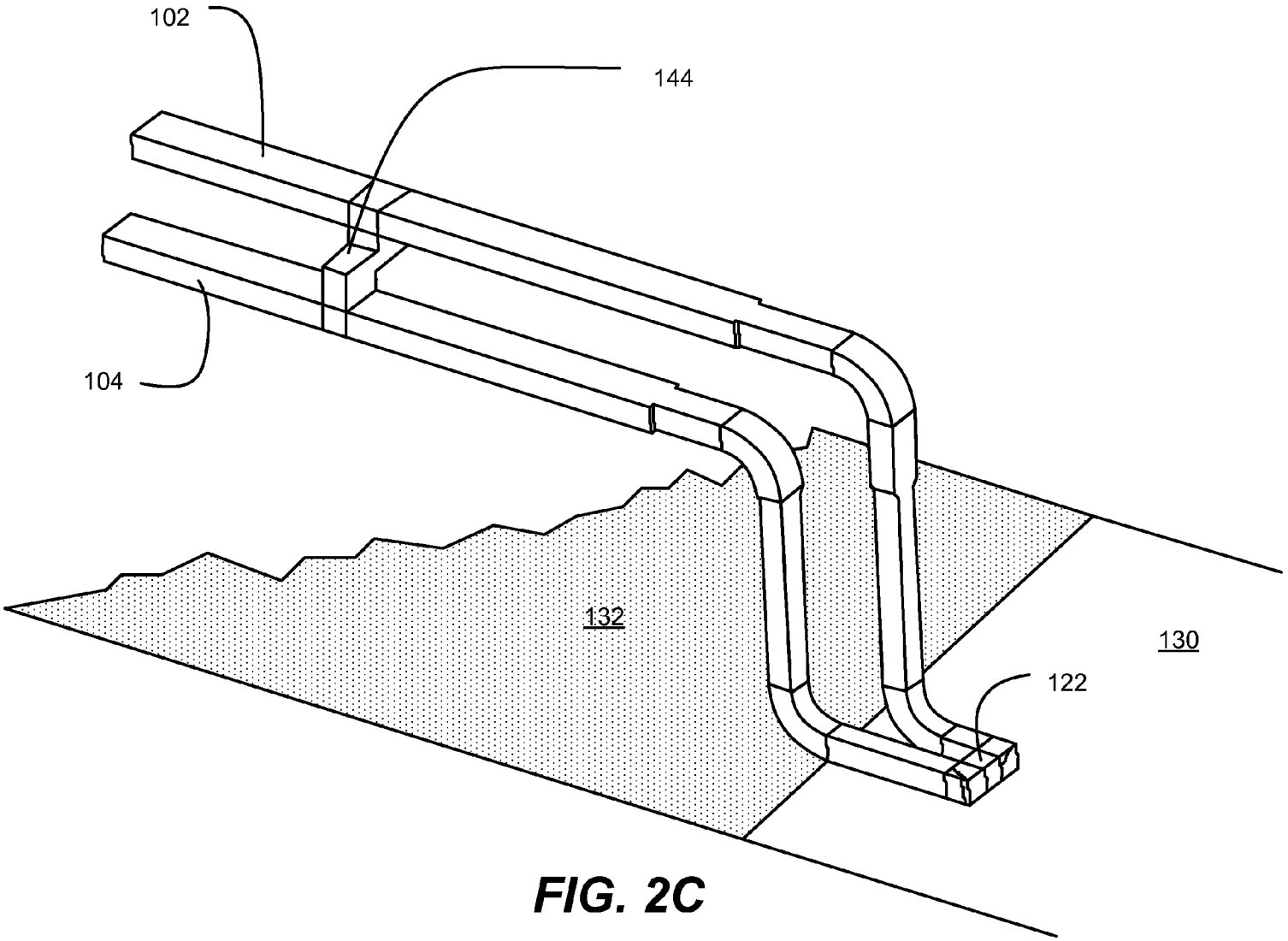
FIG. 2C is a perspective view of first and second contacts of the receptacle and conductive bridges connecting these contacts, according to one embodiment.

FIG. 2C is a perspective view of first and second contacts 102, 104 of the receptacle and first and second conductive bridges 122, 144 connecting these contacts, according to one embodiment. The first and second contacts 102, 104 extend parallel along a PCB surface 132, extends vertically down towards the PCB 130. The first conductive bridge 122 is located closer to the PCB 130 than the second conductive bridge 144.

Figure 2D:
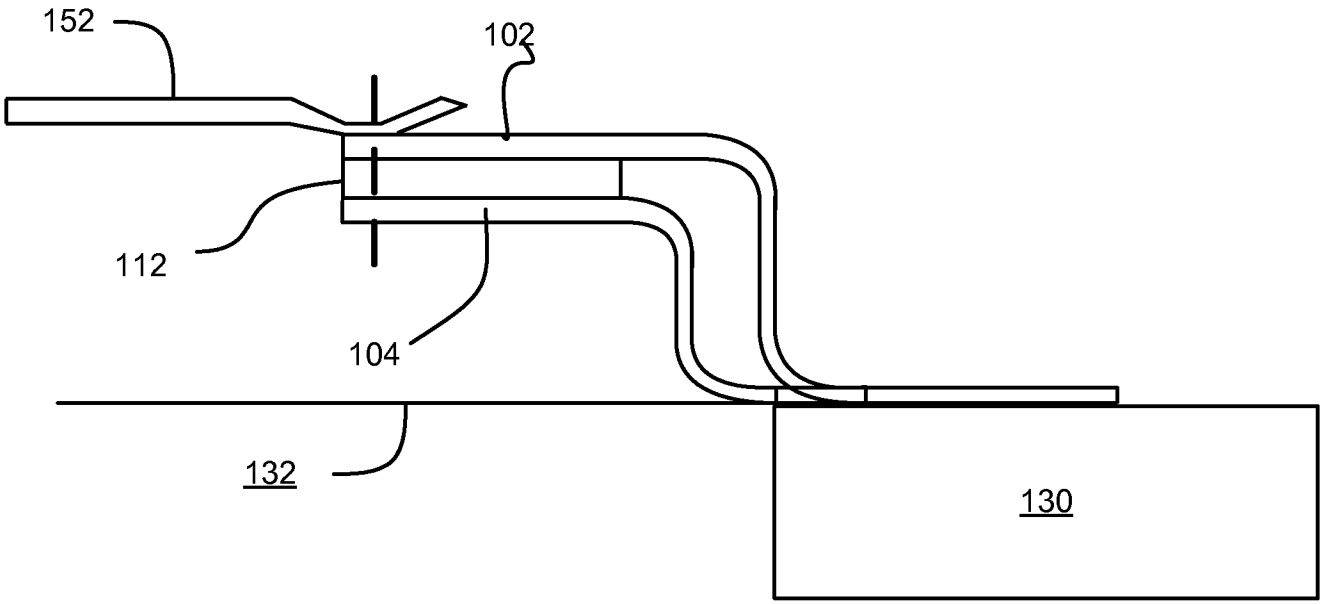
FIG. 2D is a front view of the receptacle mounted on a printed circuit board (PCB), according to one embodiment.

FIG. 2D is a front view of the receptacle mounted on the PCB 130, according to one embodiment. The first plug contact 152 is shown in FIG. 2D as coming into contact with the first contact 120.

Figure 3:
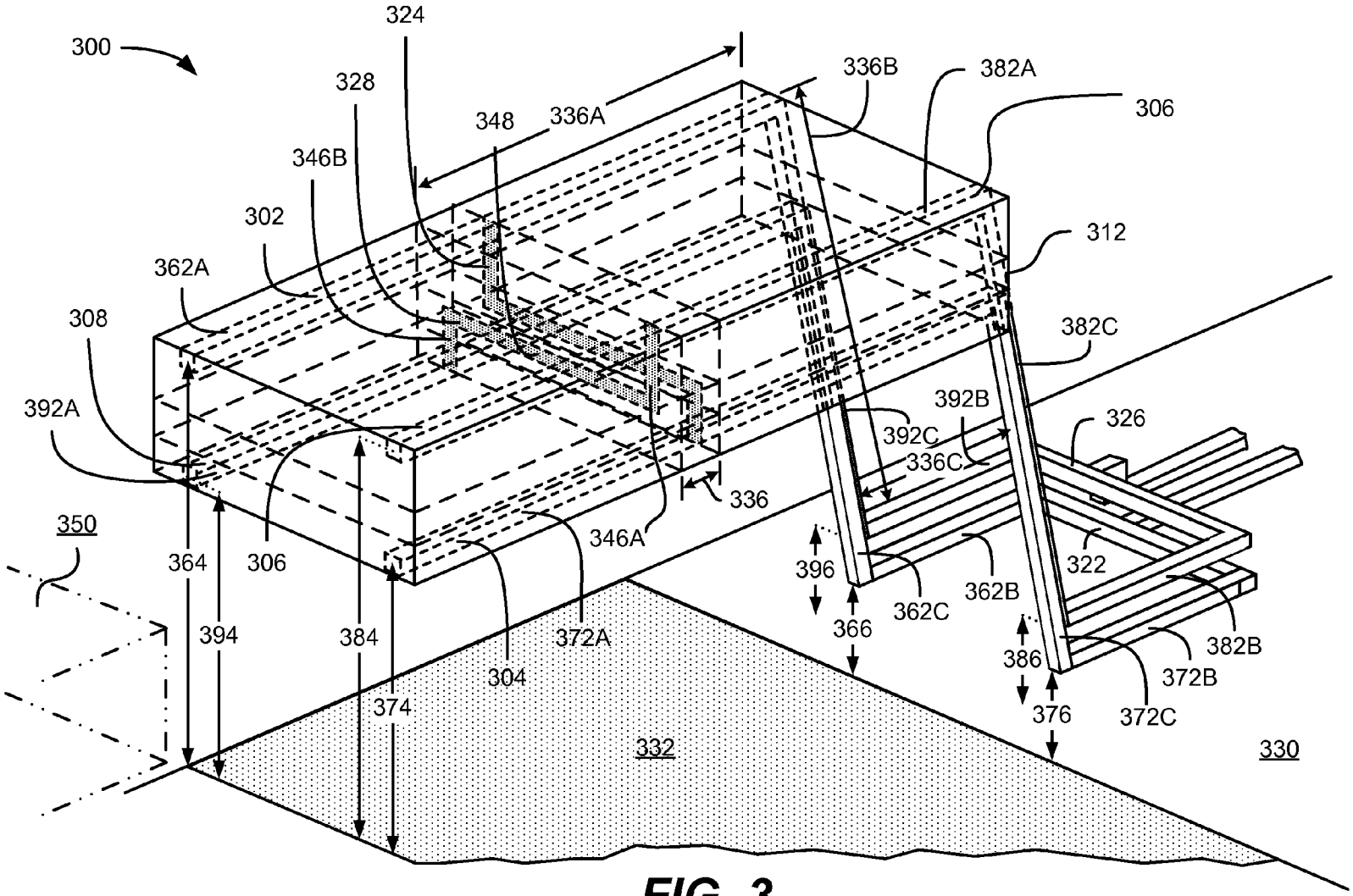
FIG. 3 is a perspective view of a receptacle for connecting to a first plug and a second plug of a connector, according to one embodiment.

FIG. 3 illustrates a perspective view of a receptacle 300 for connecting to a first plug contact 352 and a second plug contact 354 of a connector 350, according to one embodiment. Unlike the receptacle 100 of FIG. 1 where only two contacts are provided, the receptacle 300 of FIG. 3 includes a total of four contacts (e.g., first contact 302, second contact 304, third contact 306 and fourth contact 308) for connecting the first plug contact 352 and the second plug contact 354 of the connector 350 when the connector 350 engages in the first orientation or the second orientation.

The receptacle 300 connects multiple electrical paths of the connector 350 to a PCB 330 of an electronic device. The receptacle 300, the connector 350, and the PCB 330 are similar to the receptacle 100, the connector 350, and the PCB 130 of FIG. 1, respectively. In addition to the elements of the receptacle 100 illustrated in FIG. 1, the receptacle 300 of FIG. 3 includes a third contact 306 and a fourth contact 308, a third conductive bridge 326 and a fourth conductive bridge 328. The receptacle 300 includes additional contacts which are omitted in FIG. 3 to simplify the explanation.

The first contact 302, the second contact 304, the third contact 306, and the fourth contact 308 (hereinafter collectively referred to as "contacts 302 through 308") transmit signals from the connector 350 to the PCB 330 of the electronic device. The contacts 302 through 308 can be implemented using metal traces. The first contact 302 and the third contact 306 are on the first side (i.e., top-side) of the insulating member 312 and the second contact 304 and the fourth contact 308 are on the second side (i.e., bottom-side) of the insulating member. The contacts 302 through 308 extend to the PCB 330 of the electronic device.

In one embodiment, the receptacle 300 is a Universal Serial Bus (USB) Type C receptacle. The USB Type C receptacle is a receptacle 300 which conforms to the mechanical and electrical requirements of the USB Type C standard developed and maintained by the Universal Serial Bus Implementers Forum (USB-IF). The receptacle 300 complying with the USB Type C standard includes additional contacts which are omitted in FIG. 3 for the sake of convenience. In this embodiment, the first contact 302 and the third contact 306 carry differential data signals and some single-ended signals when the connector 350 engages with the receptacle 300 in the first orientation. Similarly, the second contact 304 and the fourth contact 308 carry differential data signals and some single-ended signals when the connector 350 engages with the receptacle 300 in the second orientation.

The first contact 302 and the second contact 304 are similar to the first contact 102 and the second contact 104 illustrated in FIG. 1. The first contact 302 includes a first portion 362A at a first height 364 from a PCB surface 332 and parallel to the first side (i.e., bottom-side) of the insulating member 312, a second portion 362B extending to the PCB 330 parallel to the first side of the insulating member 112 at a second height 366 from the PCB surface 332 lower than the first height 364, and a third portion 362C connecting the first portion 362A and the second portion 362B of the first contact 302. In one embodiment, the second height 366 from the PCB surface 332 is zero (i.e., the second portion 362B is on the PCB surface 332). Similarly, the second contact 304 includes a first portion 372A at a third height 374 from the PCB surface 332 and parallel to the second side (i.e., bottom-side) of the insulating member 312, a second portion 372B extending to the PCB 330 parallel to the second side of the insulating member 312 at a fourth height 376 from the PCB surface 332 lower than the third height 374, and a third portion 372C connecting the first portion 372A and the second portion 372B of the second contact 304. In one embodiment, the fourth height 376 from the PCB surface 332 is zero (i.e., the second portion 372B is on the PCB surface 332).

The third contact 306 includes a first portion 382A extending on the first side (i.e., top-side) of the insulating member 312 at a fifth height 384 from the PCB surface 332 and parallel to the first side of the insulating member 312, a second portion 382B extending to the PCB 330 parallel to the first side of the insulating member 312 at a sixth height 386 from the PCB surface 332 lower than the fifth height 384, and a third portion 382C connecting the first portion 382A and the second portion 382B of the third contact 306. In one embodiment, the fifth height 384 and the first height 364 are substantially the same, and the sixth height 386 and the second height 376 are substantially the same. In one embodiment, the sixth height 386 from the PCB surface 332 is zero (i.e., the second portion 382B is on the PCB surface 332).

The fourth contact 308 includes a first portion 392A extending on the second side (i.e., bottom-side) of the insulating member 312 at a seventh height 394 from the PCB surface 332 and parallel to the second side of the insulating member 312, a second portion 392B extending to the PCB 330 parallel to the second side of the insulating member 312 at an eighth height 396 from the PCB surface 332 lower than the seventh height 394, and a third portion 392C connecting the first portion 392A and the second portion 392B of the fourth contact 308. In one embodiment, the seventh height 394 and the third height 374 are substantially the same, and the eighth height 396 and the fourth height 366 are substantially the same. In one embodiment, the eighth height 396 from the PCB surface 332 is zero (i.e., the second portion 392B is no the PCB surface 332).

The insulating member 312 is similar to the insulating member 112 of the receptacle 100 illustrated in FIG. 1. The insulating member 312 separates the first contact 302 and the third contact 306 from the second contact 304 and the fourth contact 308 within the receptacle 300. The insulating member 312 has a similar structure as the insulating member 112 of the receptacle 100. In one embodiment, the insulating member 312 is an insulative plastic or any other composite material.

The connector 350 engages with the receptacle in each of the two orientations. Conductive bridges are provided in the receptacle 300 so that plug contacts of the connector 350 may engage with the appropriate contacts of the receptacle 300 in either orientation.

In the embodiment of FIG. 3, the first conductive bridge 322 connects the first contact 302 and the second contact 304 at a first location closer to the PCB 330 than the connector 350. Specifically, the first conductive bridge 322 connects the second portion 362B of the first contact 302 and the second portion 372B of the second contact 104. The third conductive bridge 326 connects the third contact 306 and the fourth contact 308 at a third location closer to the PCB 330 than the connector 350. Specifically, the third conductive bridge 326 connects the second portion 382B of the third contact 306 and the second portion 392B of the fourth contact 308. The first conductive bridge 322 and the third conductive bridge 326 are also separated by a distance along the path of the signal. In one embodiment, the first conductive bridge 322 height (not shown) from the PCB surface 332 is zero (i.e., the first conductive bridge 322 is on the PCB surface 332). Similarly, the second conductive bridge 326 height (not shown) form the PCB surface 332 is zero (i.e., the second conductive bridge 326 is on the PCB surface 332). In one embodiment, the third location of the third conductive bridge 326 and the first location of the first conductive bridge 322 are substantially the same. Like the first conductive bridge 122 illustrated in FIG. 1, the first conductive bridge 322 and the third conductive bridge 326 are not connected to the connector 350 and act as open stubs in the receptacle 300. The open stubs limit the bandwidth and degrade the signal quality of the signal transmitted via the contacts 302 through 308.

The second conductive bridge 324 and the fourth conductive bridge 328 reduce the effect of the open stubs. The second conductive bridge 324 connects the first contact 302 and the second contact 304 at a second location closer to the connector 350 than the first conductive bridge 322. The fourth conductive bridge 328 connects the third contact 306 and the fourth contact 308 at a fourth location closer to the connector 350 than the third conductive bridge 326. The second conductive bridge 324 and the fourth conductive bridge 328 are spatially separated from one another by a distance 336. In one embodiment, the second location of the second conductive bridge 324 and the fourth location of the fourth conductive bridge 328 are substantially the same.

In one embodiment, similar to the second conductive bridge 124 illustrated in FIG. 1, the second conductive bridge 324 and the fourth conductive bridge 328 are formed to penetrate the insulating member 312 and the first conductive bridge 322 and the third conductive bridge 326 are separated away from the insulating member 312. The fourth conductive bridge 328 includes a first portion 346A extending from the first portion 382A of the third contact 306 into the insulating member 312, a second portion 346B extending from the first portion 392A of the fourth contact 308 into the insulating member 312, and a second conductive bridge 348 extending between the first portion 346A and the second portion 346B. The second conductive bridge 348 extends from the first portion 346A to the second portion 346B and is parallel to the top or bottom surface of the insulating member 312. The second conductive bridge 324 and the fourth conductive bridge 328 are not limited to the structure illustrated in FIG. 3.

In one embodiment, the third conductive bridge 326 and the fourth conductive bridge 328 are separated by a distance. As illustrated in FIG. 3, the distance is the sum of lengths 336A, 336B, and 336C. The distance between the third conductive bridge 326 and the fourth conductive bridge 328 is less than 15 mm/$\sqrt{\epsilon_r}$ where $\epsilon_r$ represents the relative permittivity of the insulating member 112. The distance between the first conductive bridge 322 and the second conductive bridge 324 is less than the distance between the third conductive bridge 326 and the fourth conductive bridge 328.

Figure 4A:
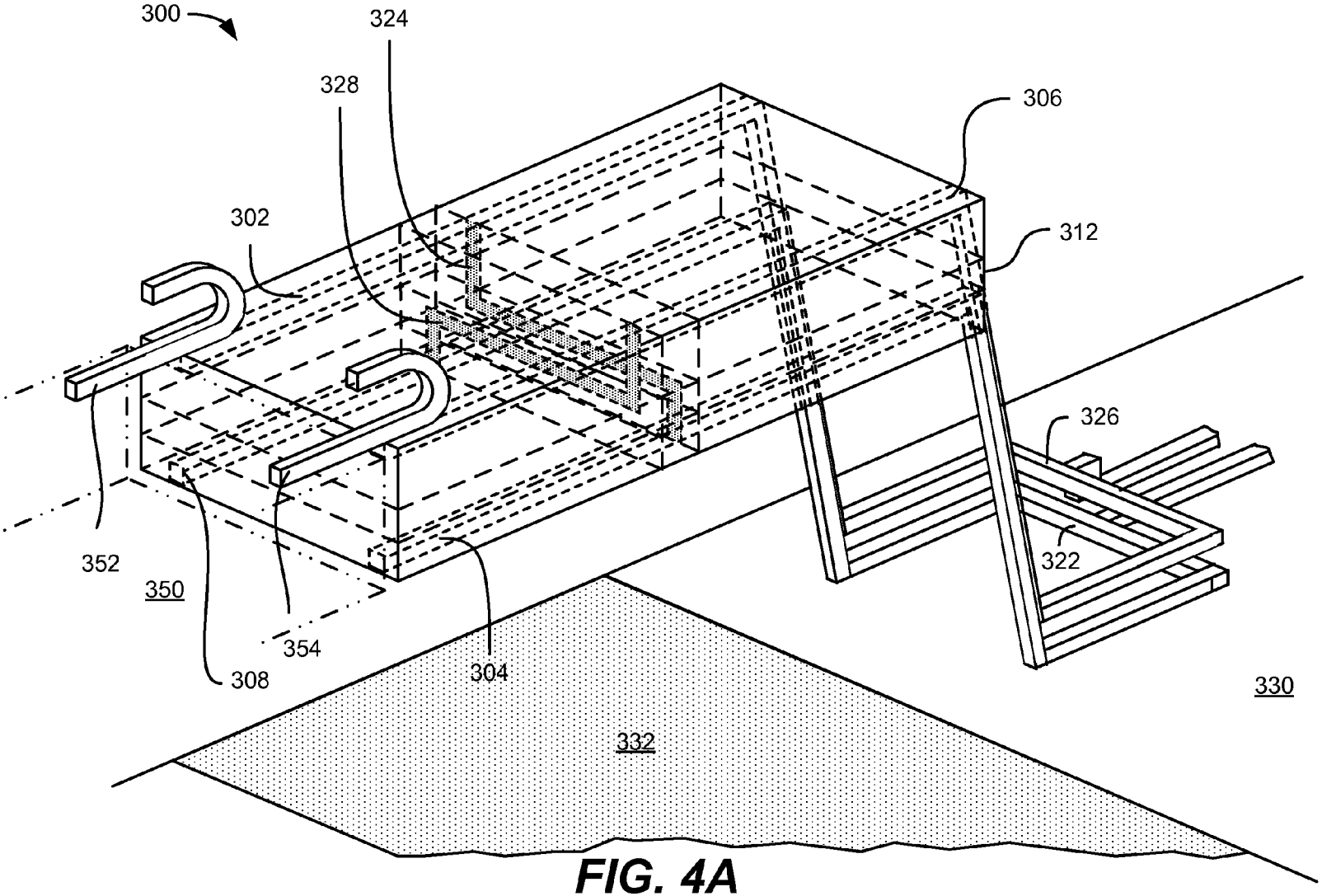
FIG. 4A is a perspective view of the receptacle illustrating the connector in a first orientation, according to one embodiment.

FIG. 4A is a perspective view of the receptacle 300 illustrating the connector 350 in the first orientation where a first plug contact 352 and a second plug contact 354 of the connector 350 are connected to the first contact 302 and third contact 306 of the receptacle 300, respectively. FIG. 4A illustrates the same embodiment of the receptacle illustrated in FIG. 3 with the connector 350 engaging the receptacle 300 in the first orientation. The first contact 302 and the third contact 306 at the first side (i.e., top side) of the receptacle 300 electrically couple with the first plug contact 352 and the second plug contact 354, respectively, when the connector 350 engages with the receptacle 300 in the first orientation. When electrically coupled with the first plug contact 352 and the second plug contact 354, the first contact 302 and the third contact 306 transmit signals from the first plug contact 352 and the second plug contact 354, respectively, to the PCB 330 of the electronic device via the first conductive bridge 322, the second conductive bridge 324, the third conductive bridge 326, and the fourth conductive bridge 328 (hereinafter collectively referred to as "conductive bridges 322 through 328").

Figure 4B:
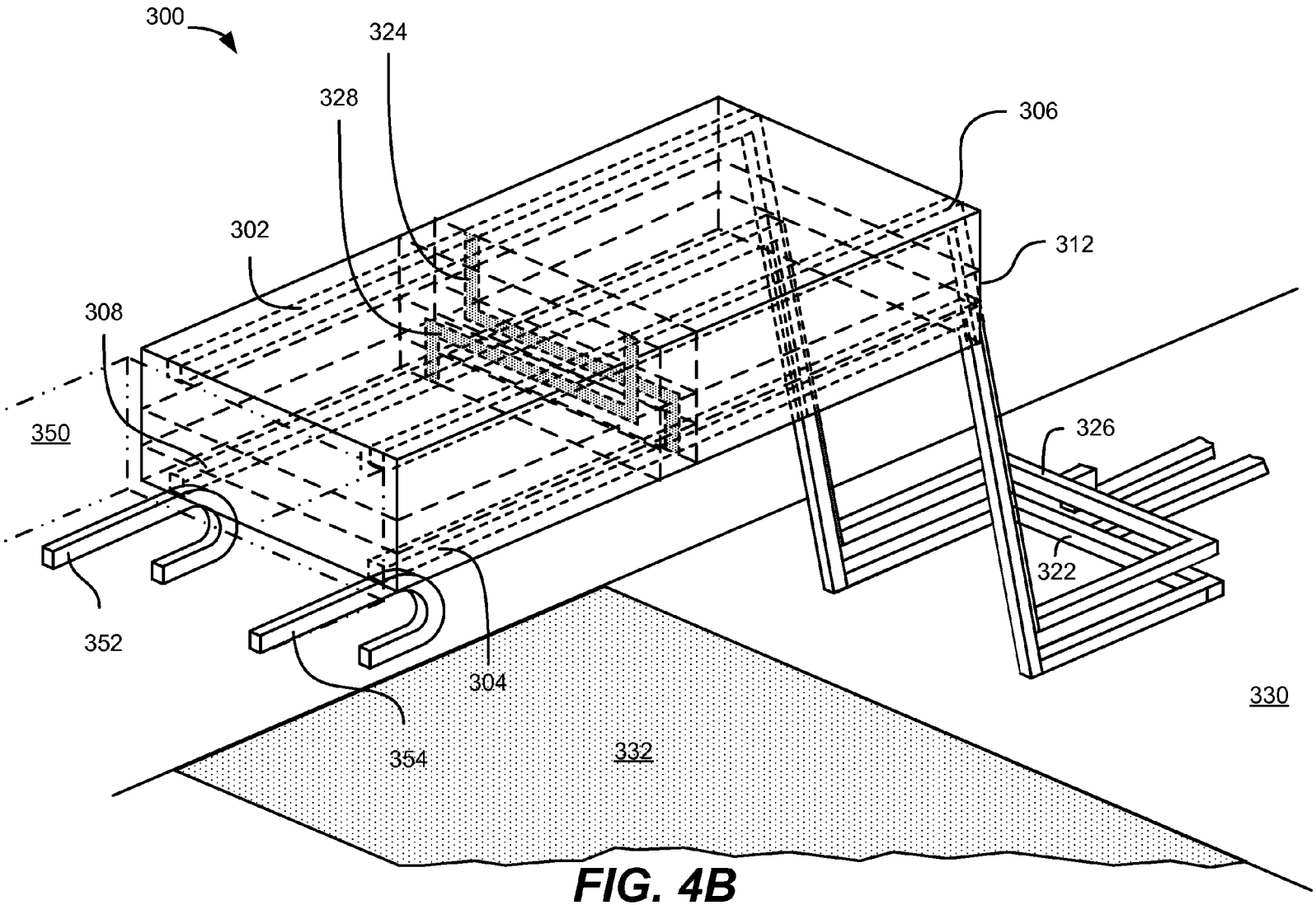
FIG. 4B is a perspective view of the receptacle illustrating the connector in a second orientation where a first plug contact and a second plug contact of the connector are connected to a second contact and a fourth contact of the receptacle, respectively, according to one embodiment.

FIG. 4B is a perspective view of the receptacle 300 illustrating the connector 350 in the second orientation where the first plug contact 352 and the second plug contact 354 of the connector 350 are connected to the second contact 304 and fourth contact 308 of the receptacle 300, respectively. FIG. 4B illustrates the same embodiment of the receptacle 300 illustrated in FIG. 3 with the connector 350 engaging with the receptacle 300 in the second orientation. That is FIG. 4B illustrates the same embodiment as FIG. 4A but with the orientation of the connector 350 reversed. The second contact 304 and the fourth contact 308 at the second side (i.e., bottom side) of the receptacle 300 electrically couple with the first plug contact 352 and the second plug contact 354, respectively, when the connector 350 engages with the receptacle 300 in the second orientation. When electrically coupled with the first plug contact 352 and the second plug contact 354, the second contact 304 and the fourth contact 308 transmit signals from the first plug contact 352 and the second plug contact 354, respectively, to the PCB 130 of the electronic device via the conductive bridges 322 through 328.

Principles described herein can be used in receptacles other than USB Type C, for example, Super Mobile High-Definition Link (MHL). Thus, while particular embodiments and applications of the present disclosure have been illustrated and described, it is to be understood that the embodiments are not limited to the precise construction and components disclosed herein.

What is claimed is:

1. A receptacle assembly for connecting to a plug of a connector, the receptacle comprising:

an insulating member;

a first contact configured to electrically connect to a first plug contact of the plug responsive to the connector engaging with the receptacle in a first orientation, the first contact provided at a first side of the insulating member;

a second contact configured to electrically connect to the first plug contact of the plug at a second side of the insulating member responsive to the connector engaging with the receptacle in a second orientation, the second contact extending to a printed circuit board of an electronic device and connected to the first contact via a first conductive bridge at a first location closer to the printed circuit board than the first plug contact; and a second conductive bridge configured to connect the first contact and the second contact at a second location closer to the first plug contact than the first conductive bridge.

2. The receptacle assembly of claim 1, wherein the second conductive bridge is formed to penetrate the insulating member and the first conductive bridge is separated away from the insulating member.

3. The receptacle assembly of claim 2, wherein a distance between the first bridge and the second bridge along the first contact is less than 15 mm/$\sqrt{\epsilon_r}$ where $\epsilon_r$ represents relative permittivity of the insulating member.

4. The receptacle assembly of claim 1, wherein the second conductive bridge comprises a first portion extending from the first contact into the insulating member, a second portion extending from the second contact into the insulating member, and a conductive path extending between the first portion and the second portion, the conductive path parallel to a top or bottom surface of the insulating member.

5. The receptacle assembly of claim 1, wherein the first contact comprises a first portion extending on at least the first side of the insulating member at a first height and parallel to the first side of the insulating member, a second portion extending to the printed circuit board parallel to the first side of the insulating member at a second height lower than the first height, and a third portion connecting the first portion and the second portion.

6. The receptacle assembly of claim 1, further comprising:

a third contact configured to electrically connect to a second plug contact of the plug responsive to the connector engaging with the receptacle in the first orientation, the third contact provided at the first side of the insulating member; and a fourth contact configured to electrically connect to the second plug contact of the plug at the second side of the insulating member responsive to the connector engaging with the receptacle in the second orientation, the fourth contact extending to the printed circuit board of the electronic device and connected to the third contact via a third conductive bridge at a third location and via a fourth conductive bridge at a fourth location closer to the plug than the third location.

7. The receptacle assembly of claim 6, wherein the fourth conductive bridge is formed to penetrate the insulating member and the third conductive bridge is separated away from the insulating member.

8. The receptacle assembly of claim 7, wherein a distance between the third bridge and the fourth bridge along the first contact is less than 15 mm/$\sqrt{\epsilon_r}$, where $\epsilon_r$ represents relative permittivity of the insulating member.

9. The receptacle assembly of claim 6, wherein the fourth conductive bridge comprises a first portion extending from the third contact into the insulating member, a second portion extending from the fourth contact into the insulating member, and a conductive path extending between the first portion and the second portion, the conductive path parallel to a top or bottom surface of the insulating member.

10. The receptacle assembly of claim 6, wherein the first location and the third location are substantially the same, and wherein the second location and the fourth location are substantially the same.

11. The receptacle assembly of claim 1, wherein the receptacle is a Universal Serial Bus (USB) Type C receptacle or a Super Mobile-High Definition Link (MHL) receptacle.

12. An electronic device comprising:

a printed circuit board; and a receptacle comprising:

an insulating member;

a first contact configured to electrically connect to a first plug contact of a connector responsive to the connector engaging with the electronic device in a first orientation, the first contact provided at a first side of the insulating member;

a second contact configured to electrically connect to the first plug contact of the connector at a second side of the insulating member responsive to the connector engaging with the electronic device in a second orientation, the second contact extending to the printed circuit board and connected to the first contact via a first conductive bridge at a first location closer to the printed circuit board than the first plug contact; and a second conductive bridge configured to connect the first contact and the second contact at a second location closer to the first plug contact than the first conductive bridge.

13. The electronic device of claim 12, wherein the second conductive bridge is formed to penetrate the insulating member and the first conductive bridge is separated away from the insulating member.

14. The electronic device of claim 13, wherein a distance between the first bridge and the second bridge along the first contact is less than 15 mm/$\sqrt{\epsilon_r}$, where $\epsilon_r$ represents relative permittivity of the insulating member.

15. The electronic device of claim 12, wherein the second conductive bridge comprises a first portion extending from the first contact into the insulating member, a second portion extending from the second contact into the insulating member, and a conductive path extending between the first portion and the second portion, the conductive path parallel to a top or bottom surface of the insulating member.

16. The electronic device of claim 12, wherein the first contact comprises a first portion extending on at least the first side of the insulating member at a first height and parallel to the first side of the insulating member, a second portion extending to the printed circuit board parallel to the first side of the insulating member at a second height lower than the first height, and a third portion connecting the first portion and the second portion.

17. The electronic device of claim 12, wherein the receptacle further comprises:

a third contact configured to electrically connect to a second plug contact of the connector responsive to the connector engaging with the electronic device in the first orientation, the third contact provided at the first side of the insulating member; and a fourth contact configured to electrically connect to the second plug contact of the connector at the second side of the insulating member responsive to the connector engaging with the electronic device in the second orientation, the fourth contact extending to the printed circuit board and connected to the third contact via a third conductive bridge at a third location and via a fourth conductive bridge at a fourth location closer to the second plug contact than the third location.

18. The electronic device of claim 17, wherein the fourth conductive bridge is formed to penetrate the insulating member and the third conductive bridge is separated away from the insulating member.

19. The electronic device of claim 18, wherein a distance between the third bridge and the fourth bridge along the first contact is less than 15 mm/$\sqrt{\epsilon_r}$ where $\epsilon_r$ represents relative permittivity of the insulating member.

20. The electronic device of claim 12, wherein the receptacle is a Universal Serial Bus (USB) Type C receptacle or a Super Mobile-High Definition Link (MHL) receptacle.

* * * * *